United States Patent [19]

Sawazaki

[11] Patent Number: 4,793,159

[45] Date of Patent: Dec. 27, 1988

[54] NEEDLE SELECTION DEVICE FOR CIRCULAR KNITTING MACHINES

[75] Inventor: Masatoshi Sawazaki, Kobe, Japan

[73] Assignee: Precision Fukuhara Works, Ltd., Japan

[21] Appl. No.: 83,206

[22] Filed: Aug. 10, 1987

[30] Foreign Application Priority Data

Feb. 27, 1987 [JP] Japan ..... 62-46286

[51] Int. Cl.[4] ..... D04B 15/78

[52] U.S. Cl. ..... 66/220

[58] Field of Search ..... 66/25, 75.2, 219, 220, 66/222, 223, 224, 229

[56] References Cited

U.S. PATENT DOCUMENTS

| | | | |
|---|---|---|---|
| 2,262,213 | 11/1941 | Tandler | 66/219 X |
| 3,733,855 | 5/1973 | Bliss-Hill et al. | 66/219 |
| 3,851,500 | 12/1974 | Wolfshagen | 66/220 |
| 4,023,383 | 5/1977 | Klinger | 66/220 X |
| 4,554,803 | 11/1985 | Schmodde et al. | 66/75.2 |

FOREIGN PATENT DOCUMENTS

| | | | |
|---|---|---|---|
| 2137680 | 3/1972 | Fed. Rep. of Germany | 66/75.2 |
| 1270880 | 4/1972 | United Kingdom | 66/220 |

*Primary Examiner*—Wm. Carter Reynolds

*Attorney, Agent, or Firm*—Bell, Seltzer, Park & Gibson

[57] ABSTRACT

The needle selection device includes a pair of vertically arranged needle selection units in advance of each yarn feeding and knitting station with one of the needle selection units being operable to select needles to knit and welt positions and the other of the selection units being operable to select needles to tuck and welt positions. The vertically arranged selection units correspond and cooperate with corresponding upper and lower selector jacks positioned beneath each knitting needle. The operation of the needle selection units is carried out along a single vertical selection line in advance of each knitting station. The vertical arrangement of the needle selection units and the selection along the single vertical line permits the knitting stations to be closely spaced adjacent to each other and permits a greater number of knitting stations to be positioned around the needle cylinder, thereby increasing the production rate of the knitting machine.

4 Claims, 3 Drawing Sheets

NEEDLE SELECTION DEVICE FOR CIRCULAR KNITTING MACHINES

FIELD OF THE INVENTION

This invention relates generally to a needle selection device for circular knitting machines, and more particularly to a needle selection device which is operable along a single vertical line in advance of a knitting station for selectively positioning needles to knit, tuck or welt positions.

BACKGROUND OF THE INVENTION

For patterning purposes, it is desirable to provide a needle selection device for a circular knitting machine which is capable of selecting needles to knit, tuck or welt and various types of selection devices are known for this general purpose; for example, this type of selection device is disclosed in U.S. Pat. No. 3,919,863. In accordance with this patent, a pair of needle selection units is positioned in side-by-side relationship and in advance of each yarn feeding and knitting station around the entire periphery of a circular knitting machine. One of the needle selection units positioned in advance of each knitting station is operable to select needles to knit or welt positions while the other selection device positioned in advance of each knitting station is operable to select needles to tuck or welt positions. In order to be able to selectively knit, tuck or welt at a given yarn knitting station, it is thus necessary to arrange two needle selection units in successive side-by-side position in advance of each of the knitting stations so that the knitting stations must be spaced apart around the circumference of the needle cylinder a sufficient distance to accommodate the two needle selection units, thereby reducing the total number of knitting stations which can be positioned around the needle cylinder of a given diameter. In order to achieve a higher production rate, it is desirable that the number of knitting stations be increased to the maximum and this requires the distance between the individual yarn knitting stations to be reduced, which is not possible when two needle selection units must be sequentially arranged in side-by-side relationship between each of the yarn knitting stations.

SUMMARY OF THE INVENTION

With the foregoing in mind, it is an object of the present invention to provide a needle selection device which permits needles to be selected to knit, tuck or welt positions at a single vertically extending selection line in advance of each knitting station to thereby permit the knitting stations to be closely spaced around the entire circumference of the needle cylinder.

In accordance with the present invention, the needle selection device is provided with two needle selection units which are positioned one above the other. One of the vertically stacked needle selection units is operable to select needles to knit or welt positions while the other of the vertically stacked needle selection units is operable to select needles to the tuck or welt positions. The selection of the needles to all three positions by the vertically stacked selection units takes place along a single vertical line in advance of each knitting station.

The vertically stacked selection units each include permanent magnets and electromagnets which select upper and lower selector jacks positioned beneath each of the needles. This arrangement permits the maximum number of knitting stations to be spaced around the needle cylinder because the needle selection is performed along a single vertical line in advance of each knitting station because the selection units are not spaced apart, as has been the practice in the prior art.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
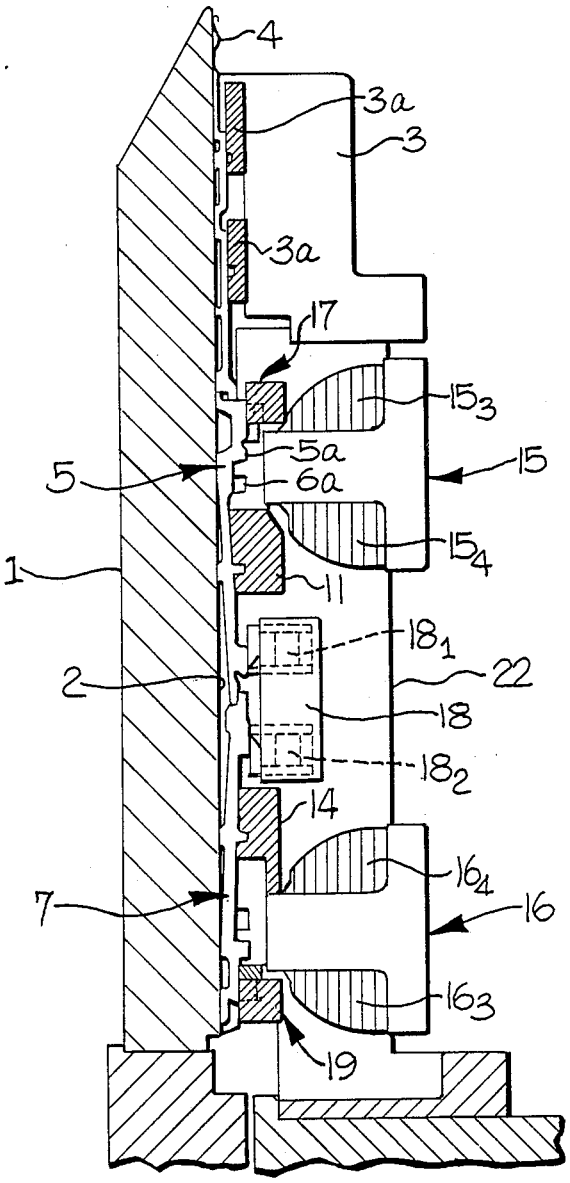
FIG. 1 is a vertical sectional view through the needle cylinder and showing the vertically stacked arrangement of the upper and lower needle selection units.

As illustrated in FIG. 1, the circular knitting machine includes latch needles 4 supported for vertical movement in needle grooves 2 formed on the outer peripheral surface of a revolving needle cylinder 1. Vertical sliding movement is imparted to the needles 4 by upper and lower cams 3*a* fixed to the inner surface of a cam holder 3. Upper rocking selector jacks, broadly indicated at 5, 6, and lower rocking selector jacks 7, 8, are alternately disposed in the needle grooves 2 below the knitting needles 4. The jacks 5–8 are supported for vertical sliding movement in the needle grooves 2 and can be rocked about respective medial fulcrum bulges 5*f*, 6*f*, 7*f* and 8*f* in a plane that is parallel to the axis of the needle cylinder 1, in a manner to be presently described.

Figure 2:
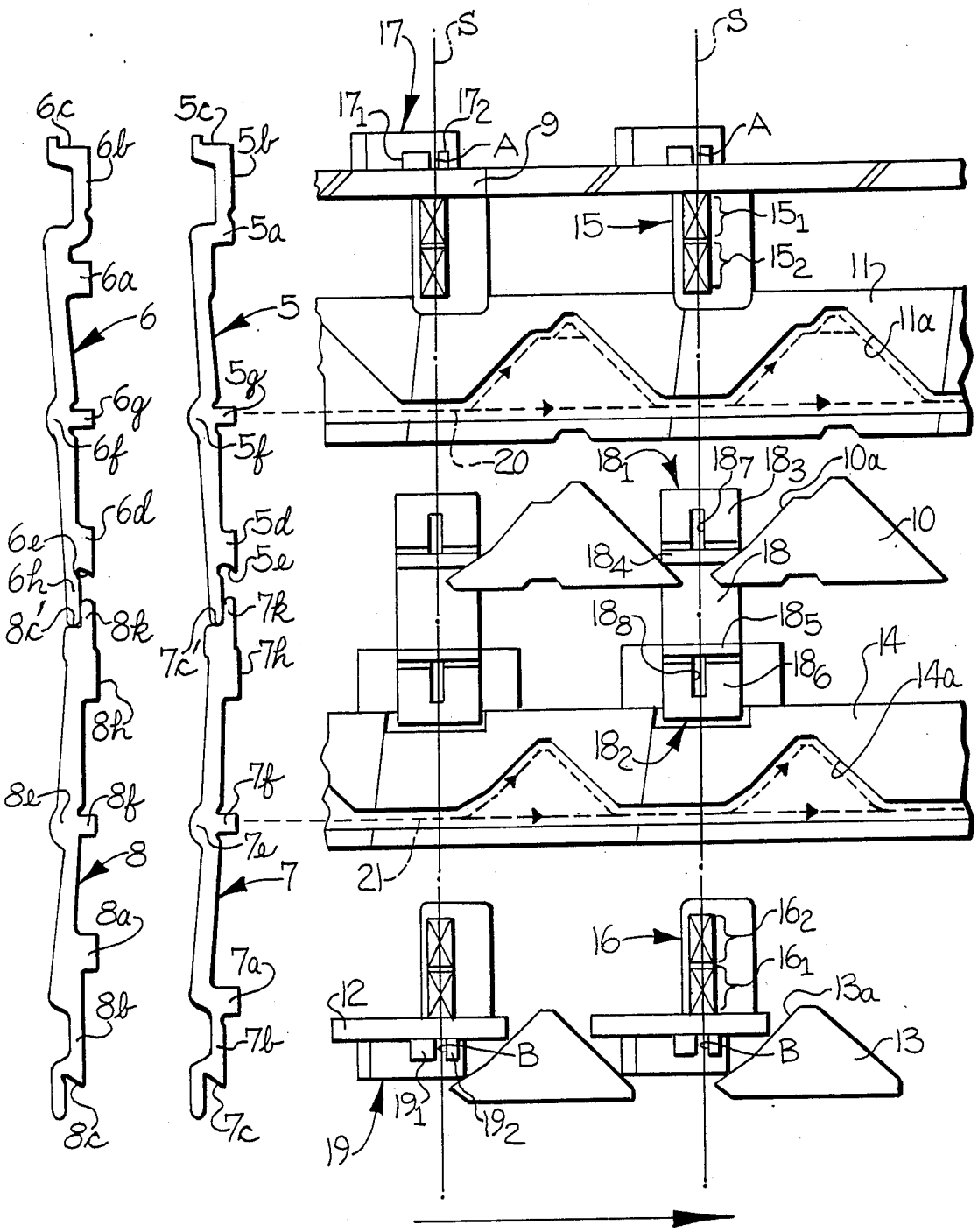
FIG. 2 is a schematic developed elevational view of the cams and needle selecting units at two adjacent knitting stations, and showing, on the left-hand side, the rocking upper and lower jacks provided beneath the alternate and intervening knitting needles.

As best shown in FIG. 2, the upper jacks 5, 6 are identical with each other in configuration except that the upper jack 5 is provided with an upper armature 5*a* while the upper jack 6 is provided with a lower armature 6*a*. The upper jacks 5, 6 are provided with respective upper vertical edges 5*b*, 6*b*, top edge portions 5*c*, 6*c*, lower vertical edges 5*d*, 6*d*, cam steps 5*e*, 6*e*, outwardly projecting butts 5*g*, 6*g*, and lower extensions 5*h*, 6*h*. The upper vertical edges 5*b*, 6*b* are adapted to engage with a cancelling cam 9 (FIG. 5) which operates to push the upper ends of the upper jacks 5, 6 inwardly toward the center of the needle cylinder 1. The top edge portions 5*c*, 6*c* are adapted to engage the lower ends of the needles 4 and push them upwardly in the needle grooves 2 of the needle cylinder 1.

The cam steps 5*e*, 6*e* on the lower portions of the projections 5*d*, 6*d* are selectively moved outwardly into position to engage and be raised up by raising slopes 10*a* of raising cams 10 positioned in advance of each knitting station. The butts 5g, 6g extend outwardly from the opposite side of the fulcrum bulges 5f, 6f and operate to lower the upper jacks 5, 6, which have been raised by the raising cam 10, by engaging the downwardly extending cam surfaces 11a of jack lowering cams 11. The lower extensions 5h, 6h are positioned adjacent and inwardly of upwardly extending extensions 7k, 8k of the lower jacks 7, 8 and at times operate to push the upper ends of the lower jacks 7, 8 outwardly of the needle cylinder 1.

The lower jacks 7, 8 (FIG. 2) are identical with each other in configuration except that the lower jack 7 is provided with a lower armature 7a while the lower jack 8 is provided with an upper armature 8a. The lower jacks 7, 8 are provided with first lower vertical edge portions 7b, 8b, cam steps 7c, 8c, inwardly extending fulcrum bulges 7e, 8e, outwardly extending operating butts 7f, 8f, and second upper vertical edge portions 7h, 8h. The first lower vertical edge parts 7b, 8b are adapted to be engaged by cancelling cams 12 (FIG. 6) to push the lower ends of the lower jacks 7, 8 toward the inside of the needle cylinder 1.

The cam steps 7c, 8c are adapted to at times be selected to move outwardly to engage raising cams 13 to raise the lower jacks 7, 8. The raising cams 13 have a lower height than the raising cams 10 so that those lower jacks 7, 8 which engage and ride up the raising cams 13 raise the corresponding needles 4 to tuck level while the cam steps 5e, 6e of the upper jacks 5, 6 which engage the upper raising cams 10 raise the corresponding needles 4 to the knit level. Upper top edges 7c', 8c' are adapted to engage the bottom portions of the extensions 5h, 6h of the upper jacks 5, 6 and push them upwardly. The fulcrum bulges 7e, 8e are positioned in a medial portion of the lower jacks 7, 8 and extend inwardly to serve as fulcrums to rock the lower jacks 7, 8.

The outwardly extending butts 7f, 8f are positioned opposite the fulcrum bulges 7e, 8e and operate to lower the lower jacks 7, 8 after they have been raised along the raising slope 13a of the raising cam 13, by engaging with downward slopes 14a of lowering cams 14. The upper vertical edge portions 7h, 8h are attracted to a third permanent magnet $18_2$ to rock the upper end portions of the lower jacks 7, 8 outwardly of the needle cylinder 1, for purposes to be presently described. Extensions 7k, 8k are adapted to be at times engaged by the lower extensions 5h, 6h of the upper jacks 5, 6 to push the lower ends of the upper jacks 5, 6 inwardly toward the inside of the needle cylinder 1.

As illustrated in FIG. 1, respective upper and lower controlling electromagnets, broadly indicated at 15, 16, are supported in spaced-apart relationship around the revolving needle cylinder 1 and in advance of each yarn feeding and knitting station. The controlling electromagnets 15, 16 are supported in a straight vertical selection line, as indicated by the dash-dot vertical lines S in FIG. 2, in advance of each of the raising cams 10, 13 at each knitting station. The controlling electromagnets 15, 16 are maintained in fixed and vertically spaced position by a cam holder bracket 22 (FIG. 1).

As shown in FIG. 2, the controlling electromagnet 15 is provided with a pair of electromagnetic surfaces $15_1$ and $15_2$ for selectively attracting the respective upper and lower armatures 5a, 6a of the upper jacks 5, 6. The lower controlling electromagnet 16 is provided with a pair of electromagnet surfaces $16_1$ and $16_2$ for selectively attracting the respective lower and upper armatures 7a, 8a of the lower jacks 7, 8. As shown in FIG. 1, respective coils $15_3$, $15_4$ are associated with and control the electromagnet 15 while coils $16_3$, $16_4$ are associated with and control electromagnet 16. The coils $15_3$, $15_4$ and $16_3$, $16_4$ are connected to an electric power source, not shown, which emits pulse current according to a prerecorded program.

A first permanent magnet, broadly indicated at 17, is positioned immediately above the upper controlling electromagnet 15 and a second permanent magnet, broadly indicated at $18_1$, is supported beneath the electromagnet 15. A third permanent magnet, broadly indicated at $18_2$, is positioned above the electromagnet 16 and a fourth permanent magnet, broadly indicated at 19, is positioned below the electromagnet 16. All four of the permanent magnets 17, $18_1$, $18_2$ and 19 are also aligned on the vertical selection line S, as shown in FIG. 2. The second permanent magnet $18_1$ and the third permanent magnet $18_2$ are supported in a housing 18 (FIG. 1) formed of nonferrous metal or other suitable material.

As shown in FIG. 2, the second permanent magnet $18_1$ is provided with individual upper and lower magnetic pieces $18_3$, $18_4$ while the third permanent magnet $18_2$ is provided with an upper magnetic piece $18_5$ and a lower magnetic piece $18_6$. The magnetic piece $18_3$ is provided with a cut-out slot $18_7$ while the magnetic piece $18_6$ is provided with a cut-out slot $18_8$ at the center to weaken the magnetic field along the vertical selection line S where needle selection takes place. The first permanent magnet 17 is located just above the cancelling cam 9 (FIGS. 2 and 5) while the fourth permanent magnet 19 is located just below the cancelling cam 12 (FIGS. 2 and 6).

Figure 5:
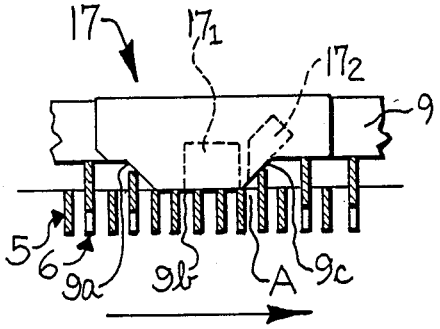
FIG. 5 is a sectional plan view looking downwardly on the upper cancelling cam and the upper permanent magnet in advance of one of the knitting stations.
Figure 6:
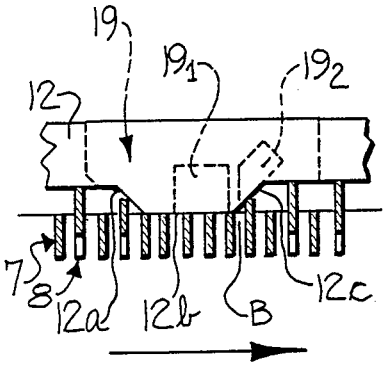
FIG. 6 is a view similar to FIG. 5 but looking downwardly on the lower cancelling cam and the lower permanent magnet.

As shown in FIGS. 5 and 6, the first permanent magnet 17 and the fourth permanent magnet 19 are shaped along their inner surfaces so that they are similar to the working inner surface of the respective cancelling cams 9 and 12. The first permanent magnet 17 comprises two permanent magnets $17_1$ and $17_2$ (FIG. 5) while the fourth permanent magnet 19 comprises two permanent magnets $19_1$ and $19_2$ (FIG. 6). Between the respective two permanent magnets 17, 19 gaps A and B are provided in alignment with the cut-out slots $18_7$ and $18_8$, and along the selection line S to reduce the magnetism along this vertical single selection line S.

Cancelling cams 9 and 12, as shown in FIGS. 5 and 6, are provided with corresponding inwardly slanting cam surfaces 9a and 12a for pushing the vertical edge parts 5b, 6b of the upper jacks 5, 6 and 7b and 8b of the lower jacks 7, 8 into the inside of the cylinder 1. The cancelling cams 9 and 12 are also provided with straight inner portions 9b and 12b for pushing the jacks into the innermost depth of the inside of the cylinder 1, and outwardly sloping cam surfaces 9c and 12c for holding the upper ends of the upper jacks drawn out by the controlling electromagnet 15 and for holding the lower ends of lowerjacks drawn out by the controlling electromagnet 16.

METHOD OF OPERATION

As has been stated, the present needle selection device is positioned along a single vertical selection line S in advance of each yarn feeding and knitting station and is operable to select individual needles 4 to either knit, tuck or welt at the next knitting station. When it is desired to cause a needle 4 to knit at a particular yarn feeding and knitting station, pulse signals are not transmitted to the controlling electromagnets 15, 16 in advance of that particular knitting station and the butts 5g, 6g of the upper jacks 5, 6 and the butts 7f, 8f of the lower jacks 7, 8 approach the selecting point, indicated by the dash-dot line S, as they move along respective upper and lower dotted line pathways 20, 21, as shown in FIG. 2. The vertical upper edge portions 5b, 6b of upper jacks 5, 6 engage and are pushed inwardly by the inclined cam surface 9a of the cancelling cam 9 (FIG. 5) so that the lower ends of the upper jacks 5, 6 are rocked outwardly of the needle cylinder 1, as shown in FIG. 1. At the same time, the lower vertical edge portions 7b, 8b of the lower jacks 7, 8 are pushed inwardly by the inwardly sloping cam 12a of the lower cancelling cam 12 (FIG. 6) so that the upper ends of the lower jacks 7, 8 are rocked outwardly, as shown in FIG. 1. Also, the lower vertical edges 5d, 6d of the upper jacks 5, 6 are attracted to the magnetic surfaces $18_3$ and $18_4$ of the second permanent magnet $18_1$ while the vertical edge parts 7h and 8h of the lower jacks 7, 8 are attracted to the magnetic surfaces $18_5$ and $18_6$ of the third permanent magnet $18_2$. Thus, the position of the jacks is fixed when the upper jacks 5, 6 and lower jacks 7, 8 reach the straight areas 9b and 12b of cancelling cams 9 and 12 with the upper end of the upper jacks 5, 6 and the lower ends of the lower jacks 7, 8 being rocked to the innermost position relative to the needle cylinder 1, as shown in FIG. 1.

As the needle cylinder 1 continues to rotate, magnetism of the first permanent magnet $17_1$ is added to the vertical edge portions 5b and 6b of the upper jacks 5, 6 and also magnetism of the fourth permanent magnet 19 is added to the vertical edge portions 7b, 8b of the lower jacks 7, 8 so that they are held in this position by the permanent magnet surfaces $17_1$ and $19_1$ so that the lower ends of the upper jacks 5, 6 and the upper ends of the lower jacks 7, 8 are further firmly held in the outermost position, relative to the needle cylinder 1.

With further cylinder rotation, the upper jacks 5, 6 and lower jacks 7, 8 reach the position on the vertical selection line S that lies between the cut-outs $18_7$ and $18_8$, the gap A of the first permanent magnet 17, and the gap B of the fourth permanent magnet 19. As the jacks pass these cut-outs, the effect of the permanent magnets is weakened temporarily by retention of the jacks with only corresponding magnetic pieces $18_4$ and $18_5$. At this point, selection of the jacks to either cause the corresponding needles to tuck or welt will be carried out when proper pulse current is fed to the coils of controlling electromagnets 15, 16, in a manner to beddescribed below.

After passing cut-out slots $18_7$ and $18_8$ the upper jacks 5, 6 and the lower jacks 7, 8 are again subjected to the magnetic force of magnetic pieces $18_3$ and $18_6$ and lower vertical edges 5d and 6d with the cam steps 5e and 6e being held in an outermost position so that they engage with the raising slope 10a of the raising cam 10 to raise the same upwardly. The corresponding top parts 5c and 6c of the upper jacks 5, 6 abut against the bottom of the needles 4 and raise the needles upwardly to knit position to pick up yarn and knit the same at the next succeeding knitting station.

After reaching the highest knit position, the upper jacks 5, 6 are lowered as their corresponding butts 5g, 6g engage and move along the downwardly inclined slope 11a of lowering cam 11. In the meantime, the lower jacks 7, 8 pass the raising cam 13 without engaging the same so that they remain in a lowered position and the butts 7f, 8f move in a straight line along the dotted pathway 21.

Figure 3:
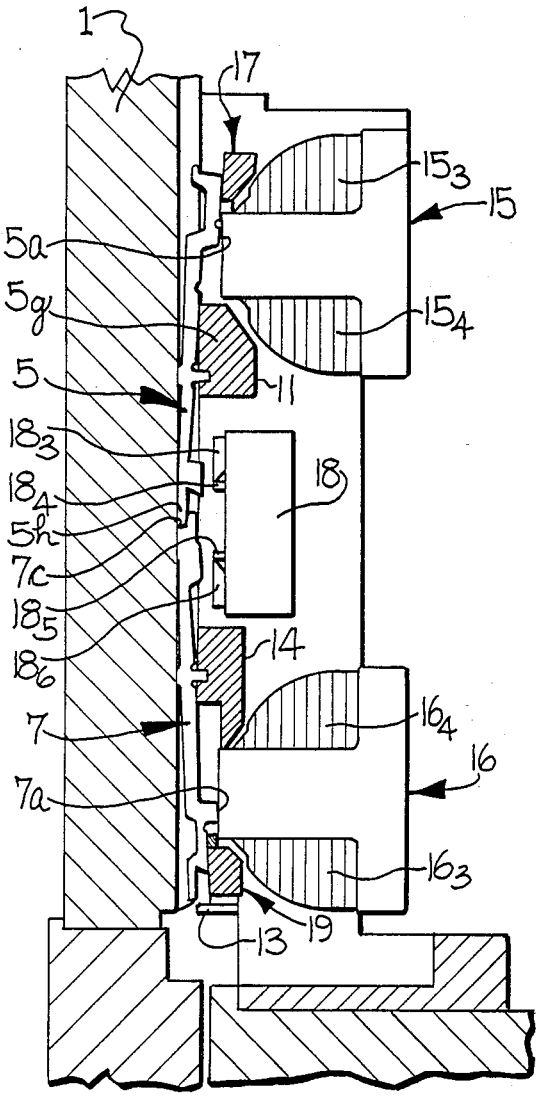
FIG. 3 is an enlarged vertical sectional view similar to the lower portion of FIG. 1 and illustrating the upper and lower jaws selected and rocked into position to move the corresponding needle to the tuck position.

In order to cause selected needles 4 to be raised to the tuck position at a given yarn knitting station, pulse current is fed to coils $15_1$, $15_2$ of the controlling electromagnet 15 and to coils $16_1$ and $16_2$ of controlling electromagnet 16 according to the program set forth in the prerecorded knitting pattern. Needles 4 are selected to be raised to tuck level by operation of the controlling electromagnets 15, 16 as the corresponding upper jacks 5, 6 and lower jacks 7, 8 pass the vertical selection line S where the magnetic force of the permanent magnets is weak between cut-out slots $18_7$ and $18_8$ and the gap A of the first permanent magnet 17 and the gap B of the fourth permanent magnet 19. At this point, the controlling electromagnets 15, 16 attract the armatures 5a, 6a of the upper jacks 5, 6 and the armatures 7a, 8a of the lower jacks 7, 8 so that the lower end of the upper jacks 5, 6 and the upper end of the lower jacks 7, 8 are rocked inwardly of the needle cylinder 1, as illustrated in FIG. 3. The upper jacks 5, 6 are not raised by the raising cam 10 while the lower jacks 7, 8 engage and are raised by the raising cam 13. The cam steps 7c, 8c of the lower jacks 7, 8 are raised up the inclined slope 13a of the raising cam 13 and to thereby raise the corresponding upper jack 5, 6 and the corresponding needle 4 to the tuck position. Butts 5g, 6g of upper jacks 5, 6 descend along downward slope 11a of lowering cam 11 after the jacks 5, 6 have been raised to tuck level. Also, after lower jacks 7, 8 are raised, butts 7f, 8f of lower jacks 7, 8 descend along downward slope 14a of lowering cam 14 while the needle 4 descends by engagement with the conventional needle cam action.

Figure 4:
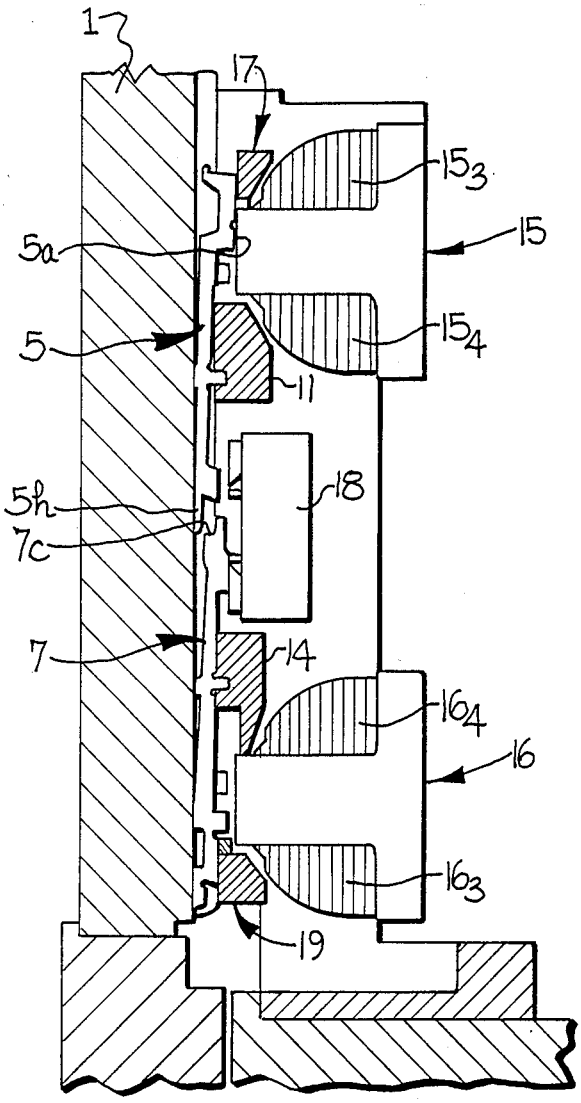
FIG. 4 is a view similar to FIG. 3 but showing the jacks selected and rocked into position so that the corresponding needle remains in a welt position.

When it is desired to position selected needles 4 in the welt position, a pulse current is fed to coils $15_1$ or $15_2$ of controlling electromagnet 15 according to the program that is stored in the knitting pattern when that particular needle 4 and the corresponding upper and lower jacks 5, 6 and 7, 8 approach the needle selection line S. The armature 5a of upper jack 5 or 6a of upper jack 6 is attracted by the magnetic surfaces $15_1$ or $15_2$ to cause the lower ends of the corresponding upper jacks 5, 6 to be moved inwardly of the needle cylinder, as shown in FIG. 4. At the same time, the lower ends of the lower jacks 7, 8 remain in the innermost position, as shown in FIG. 4, so that the lower ends of both the upper jacks 5, 6 and the lower jacks 7, 8 remain inwardly and do not engage and ride up the corresponding raising cams 10, 13. The corresponding butts 5g, 6g and 7f, 8f of the upper and lower jacks continue their straight line path of travel along the respective dotted lines 20, 21 and the corresponding needles 4 remain in the lower welt positions.

Thus, the needle selection device of the present invention includes both upper and lower jack selection units which operate the respective upper and lower jacks along a single vertical selection line in advance of each knitting station. Computer calculation is simplified because needle selection takes place on a single vertical line in advance of each knitting station. Also, energy saving is achieved because both of the controlling electromagnets of the upper and lower needle selection units are energized only when tuck needle selection is made, as shown in FIG. 3, and that is infrequent. Only the controlling electromagnet of the upper selection unit is energized when welt needle selection takes place, as shown in FIG. 4, and neither of the controlling electromagnets of the upper or lower selection units are energized when the needles are selected to knit, as illustrated in FIG. 1. By carrying out the needle selection along a single vertical selection line in advance of each knitting station, it is possible to space the needle stations closer together around the periphery of the needle cylinder and thereby increase production of the knitting machine.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A needle selection device for circular knitting machines including a plurality of closely spaced knitting stations surrounding a needle cylinder having needle grooves spaced therearound, a needle supported for vertical sliding movement in each of the needle grooves, and upper and lower selector jacks positioned beneath each needle, said lower selector jack being directly engageable with said upper selector jack and said upper selector jack being directly engageable with said needle, said needle selection device being positioned in advance of each of said knitting stations and including two vertically arranged needle selection units, one of said needle selection units being operable to select needles to knit and welt positions, and the other of said needle selection units being operable to select needles to tuck and welt positions, and wherein said two needle selection units are arranged one above the other so that needle selection takes place along a single vertical line in advance of each knitting station.

2. A needle selection device according to claim 1 wherein one of said selection units is adapted to selectively position said upper jacks, and said other selection unit is adapted to selectively position said lower jacks.

3. A needle selection device according to claim 2 wherein each of said upper and lower selector jacks is supported for rocking pivotal movement about a medial position along the length thereof, and wherein said two selection units each includes upper and lower permanent magnets and a single electromagnet operable to selectively position said upper and lower jacks.

4. A needle selection device according to claim 3 including a raising cam engageable by one of said selector jacks and being operable to raise corresponding needles to a knit level, and a raising cam engageable by the other of said selector jacks and being operable to raise the corresponding upper jack and needle to a tuck level.

* * * * *